US010280779B2

(12) United States Patent
Simonds

(10) Patent No.: US 10,280,779 B2
(45) Date of Patent: May 7, 2019

(54) PLUG SEAL FOR GAS TURBINE ENGINE

(71) Applicant: United Technologies Corporation, Hartford, CT (US)

(72) Inventor: Mark E. Simonds, Cape Neddick, ME (US)

(73) Assignee: United Technologies Corporation, Farmington, CT (US)

( * ) Notice: Subject to any disclaimer, the term of this patent is extended or adjusted under 35 U.S.C. 154(b) by 326 days.

(21) Appl. No.: 14/916,752

(22) PCT Filed: Sep. 8, 2014

(86) PCT No.: PCT/US2014/054530
§ 371 (c)(1),
(2) Date: Mar. 4, 2016

(87) PCT Pub. No.: WO2015/076906
PCT Pub. Date: May 28, 2015

(65) Prior Publication Data

US 2016/0215642 A1 Jul. 28, 2016

Related U.S. Application Data

(60) Provisional application No. 61/875,782, filed on Sep. 10, 2013.

(51) Int. Cl.
*F01D 11/00* (2006.01)
*F01D 9/04* (2006.01)
(Continued)

(52) U.S. Cl.
CPC ..... *F01D 11/005* (2013.01); *F01D 9/041* (2013.01); *F04D 29/083* (2013.01);
(Continued)

(58) Field of Classification Search
CPC ..... F01D 9/04; F01D 9/041; F01D 11/003; F01D 11/005; F01D 25/24; F04D 29/08;
(Continued)

(56) References Cited

U.S. PATENT DOCUMENTS 3,918,832 A 11/1975 Shuttleworth et al.
4,897,021 A 1/1990 Chaplin et al.
(Continued)

FOREIGN PATENT DOCUMENTS

EP 1074696 2/2001
EP 2479384 7/2012
JP 2012225242 11/2012

OTHER PUBLICATIONS

Supplementary European Search Report for Application No. 14864377.8 dated May 11, 2017.
(Continued)

*Primary Examiner* — Carlos A Rivera
*Assistant Examiner* — Sang K Kim
(74) *Attorney, Agent, or Firm* — Carlson, Gaskey & Olds, P.C.

(57) ABSTRACT

An example seal includes, among other things, a plug body to limit flow through an axially extending interface between a first component and a second component, the plug body to flow when positioned within both a cavity of the first component and a cavity of the second component.

17 Claims, 5 Drawing Sheets

(51) Int. Cl.
*F04D 29/08* (2006.01)
*F04D 29/54* (2006.01)

(52) U.S. Cl.
CPC ..... *F04D 29/542* (2013.01); *F05D 2220/32* (2013.01); *F05D 2230/60* (2013.01); *F05D 2240/11* (2013.01)

(58) Field of Classification Search
CPC .. F04D 29/083; F04D 29/542; F05D 2220/32; F05D 2230/60; F05D 2240/11; F05D 2240/55
See application file for complete search history.

(56) References Cited

U.S. PATENT DOCUMENTS 5,154,577 A 10/1992 Kellock et al.
5,346,362 A * 9/1994 Bonner ..... F01D 11/005 415/119
5,707,207 A * 1/1998 Benoist ..... F01D 11/005 277/415
6,893,215 B2 * 5/2005 Kuwabara ..... F01D 11/005 415/115
7,032,904 B2 4/2006 Rogers
7,950,900 B2 5/2011 Mulcaire et al.
2005/0082768 A1 4/2005 Iguchi et al.
2006/0177301 A1 8/2006 Shiozaki et al.
2006/0263204 A1 11/2006 London et al.
2009/0238683 A1 9/2009 Alvanos et al.
2012/0189424 A1 7/2012 Propheter-Hinckley et al.
2012/0269622 A1 * 10/2012 Takaoka ..... F01D 9/04 415/208.1
2013/0177387 A1 7/2013 Rioux
2013/0202408 A1 8/2013 Laurello et al.
2015/0030442 A1 * 1/2015 Waki ..... F01D 11/005 415/209.3

OTHER PUBLICATIONS

International Search Report and Written Opinion for Application No. PCT/US2014/054530 dated Jun. 16, 2015.
International Preliminary Report on Patentability for Application No. PCT/US2014/054530 dated Mar. 24, 2016.

* cited by examiner

PLUG SEAL FOR GAS TURBINE ENGINE

CROSS-REFERENCE REGARDING RELATED APPLICATION

This application claims priority to U.S. Provisional Application No. 61/875,782 filed Sep. 10, 2013.

STATEMENT REGARDING GOVERNMENT SUPPORT

This invention was made with government support under Contract No. N68335-13-C-0005 awarded by the United States Navy. The Government has certain rights in this invention.

BACKGROUND

This disclosure relates to sealing areas of a gas turbine engine and, more particularly, to sealing interfaces between circumferentially adjacent components, such as inner air seals.

A gas turbine engine typically includes a fan section, a compressor section, a combustor section, and a turbine section. Air entering the compressor section is compressed and delivered into the combustor section where it is mixed with fuel and ignited to generate a high-speed exhaust gas flow. The high-speed exhaust gas flow expands through the turbine section to drive the compressor and the fan section. The compressor section typically includes low and high pressure compressors, and the turbine section includes low and high pressure turbines.

In some gas turbine engines, a speed reduction device, such as an epicyclical gear assembly, is utilized to drive the fan section such that the fan section may rotate at a speed different and typically slower than the turbine section to provide a reduced part count approach for increasing the overall propulsive efficiency of the engine. In such engine architectures, a shaft driven by one of the turbine sections provides an input to the epicyclical gear assembly that drives the fan section at a reduced speed so that both the turbine section and the fan section can rotate at closer to optimal speeds.

Gas turbine engines can include various sealing interfaces, such as rotor knife edges that seal against inner air seals. Interfaces between circumferentially adjacent inner air seals can undesirably allow flow from one axial side of the inner air seal to another axial side of the inner air seal.

SUMMARY

A seal according to an exemplary aspect of the present disclosure includes, among other things, a plug body to limit flow through an axially extending interface between a first component and a second component, the plug body to limit flow when positioned within both a cavity of the first component and a cavity of the second component.

In a further non-limiting embodiment of the foregoing seal, the seal may include a fin extending radially from the plug body.

In a further non-limiting embodiment of any of the foregoing seals, the fin extends axially a distance that is less than or equal to 0.025 inches.

In a further non-limiting embodiment of any of the foregoing seals, the fin is configured to fit within a groove of the first component.

In a further non-limiting embodiment of any of the foregoing seals, an inner air seal defines at least a portion of the groove.

In a further non-limiting embodiment of any of the foregoing seals, the groove is a radially extending groove that has a circumferential depth that is less than or equal to 0.030 inches.

In a further non-limiting embodiment of any of the foregoing seals, about half of the plug is positioned within the cavity of the first component, and about half of the plug is positioned within the cavity of the second component.

In a further non-limiting embodiment of any of the foregoing seals, the first component comprises a stator having a circumferential length, and the amount of the plug received within the cavity of the first component is about half of the circumferential length.

A sealing assembly according to an exemplary aspect of the present disclosure includes, among other things, a first component that includes a first inner air seal and at least partially defines a first cavity, a second component that includes a second inner air seal and at least partially defines a second cavity, and a seal that is received within both the first cavity and the second cavity. The seal is to limit flow through an axially extending interface.

In a further non-limiting embodiment of the foregoing sealing assembly, a first stator platform defines the first cavity together with a first carrier, and a second stator platform that defines the second cavity together with a second carrier.

In a further non-limiting embodiment of any of the foregoing sealing assemblies, the axially extending interface is within an array of stator clusters.

In a further non-limiting embodiment of any of the foregoing sealing assemblies, the first and second inner air seals are honeycomb seals.

In a further non-limiting embodiment of any of the foregoing sealing assemblies, knife-edge seals interface directly with the first and second inner air seals.

In a further non-limiting embodiment of any of the foregoing sealing assemblies, a flange extends radially from the seal, the flange received with a groove of the first inner air seal.

In a further non-limiting embodiment of any of the foregoing sealing assemblies, the sealing assembly forms a portion of a gas turbine engine having a geared architecture.

A method of sealing an interface according to another exemplary aspect of the present disclosure includes, among other things, positioning a first portion of a seal within a cavity of a first component, positioning a second portion of the seal within a cavity of a second component, and limiting flow through an axially extending interface between the first component and the second component using the seal.

In a further non-limiting embodiment of the foregoing method of sealing an interface, the method includes fitting a fin extending radially from a plug body of the seal within a radially extending groove provided by the first component.

In a further non-limiting embodiment of any of the foregoing methods of sealing an interface, the method includes including providing the cavity of the first component with a first carrier that supports a first inner air seal, and providing the cavity of the second component with a second carrier that supports a second inner air seal.

In a further non-limiting embodiment of any of the foregoing methods of sealing an interface, the first and second components are within an array of stator clusters.

In a further non-limiting embodiment of any of the foregoing methods of sealing an interface, the method includes sealing against a knife-edge seal using the first component.

BRIEF DESCRIPTION OF THE DRAWINGS

These and other features of the disclosed examples can be best understood from the following specification and drawings, the following of which is a brief description.

DETAILED DESCRIPTION

Figure 1:
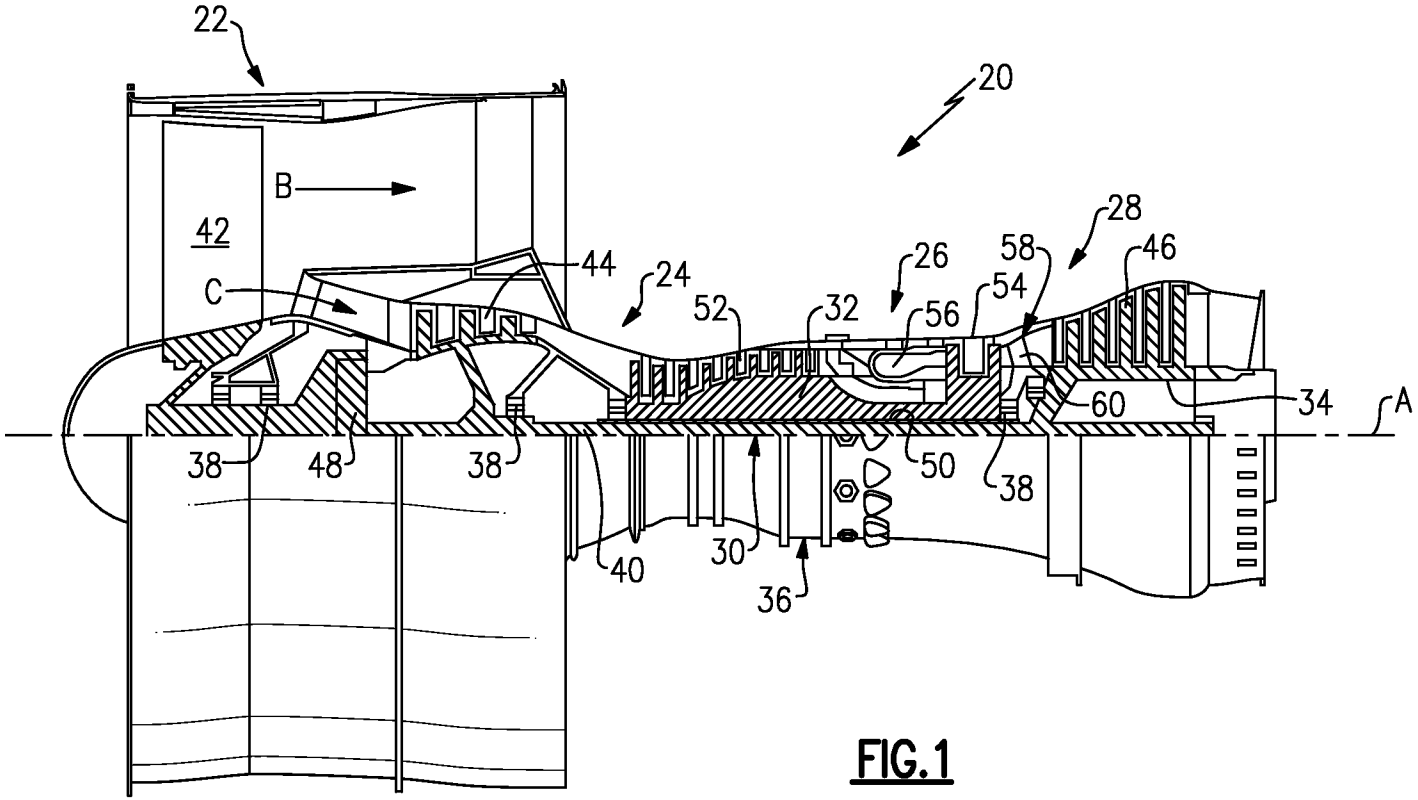
FIG. 1 schematically illustrates an example gas turbine engine.
Figure 2:
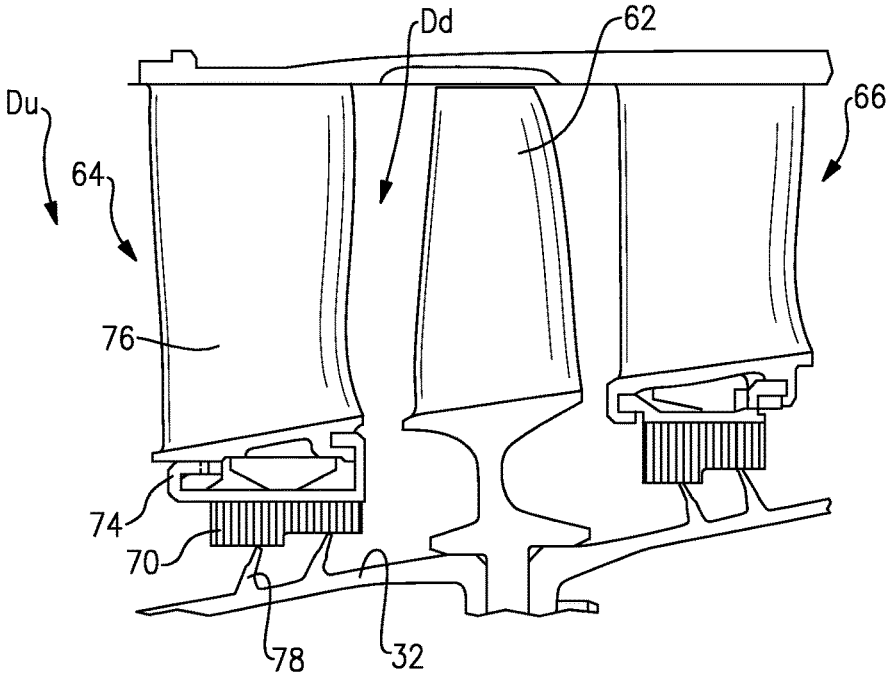
FIG. 2 shows a close-up view of a portion of a compressor section of the engine of FIG. 1.
Figure 3:
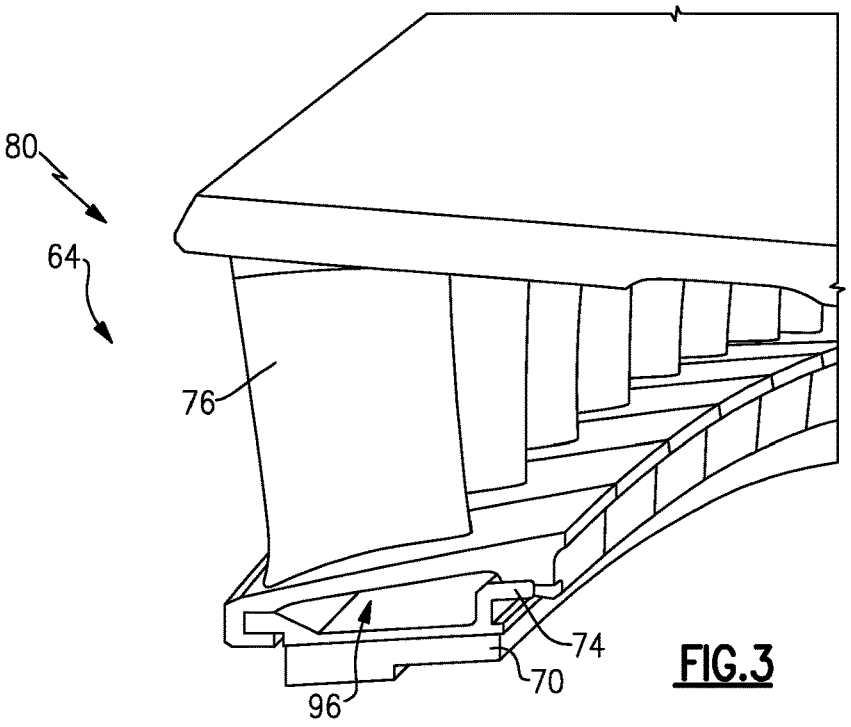
FIG. 3 shows a perspective view of a stator cluster from the compressor section of FIG. 2.

FIG. 1 schematically illustrates an example gas turbine engine 20 that includes a fan section 22, a compressor section 24, a combustor section 26, and a turbine section 28. Alternative engines might include an augmenter section (not shown) among other systems or features. The fan section 22 drives air along a bypass flow path B while the compressor section 24 draws air in along a core flow path C where air is compressed and communicated to a combustor section 26. In the combustor section 26, air is mixed with fuel and ignited to generate a high pressure exhaust gas stream that expands through the turbine section 28 where energy is extracted and utilized to drive the fan section 22 and the compressor section 24.

Although the disclosed non-limiting embodiment depicts a turbofan gas turbine engine, it should be understood that the concepts described herein are not limited to use with turbofans as the teachings may be applied to other types of turbine engines; for example a turbine engine including a three-spool architecture in which three spools concentrically rotate about a common axis and where a low spool enables a low pressure turbine to drive a fan via a gearbox, an intermediate spool that enables an intermediate pressure turbine to drive a first compressor of the compressor section, and a high spool that enables a high pressure turbine to drive a high pressure compressor of the compressor section.

The example engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that connects a fan 42 and a low pressure (or first) compressor section 44 to a low pressure (or first) turbine section 46. The inner shaft 40 drives the fan 42 through a speed change device, such as a geared architecture 48, to drive the fan 42 at a lower speed than the low speed spool 30. The high speed spool 32 includes an outer shaft 50 that interconnects a high pressure (or second) compressor section 52 and a high pressure (or second) turbine section 54. The inner shaft 40 and the outer shaft 50 are concentric and rotate via the bearing systems 38 about the engine central longitudinal axis A.

A combustor 56 is arranged between the high pressure compressor 52 and the high pressure turbine 54. In one example, the high pressure turbine 54 includes at least two stages to provide a double stage high pressure turbine 54. In another example, the high pressure turbine 54 includes only a single stage. As used herein, a "high pressure" compressor or turbine experiences a higher pressure than a corresponding "low pressure" compressor or turbine.

The example low pressure turbine 46 has a pressure ratio that is greater than about five (5). The pressure ratio of the example low pressure turbine 46 is measured prior to an inlet of the low pressure turbine 46 as related to the pressure measured at the outlet of the low pressure turbine 46 prior to an exhaust nozzle.

A mid-turbine frame 58 of the engine static structure 36 is arranged generally between the high pressure turbine 54 and the low pressure turbine 46. The mid-turbine frame 58 further supports bearing systems 38 in the turbine section 28 as well as setting airflow entering the low pressure turbine 46.

The core airflow flowpath C is compressed by the low pressure compressor 44 then by the high pressure compressor 52 mixed with fuel and ignited in the combustor 56 to produce high speed exhaust gases that are then expanded through the high pressure turbine 54 and low pressure turbine 46. The mid-turbine frame 58 includes stator vanes 60, which are in the core airflow path and function as an inlet guide vane for the low pressure turbine 46. Utilizing the stator vanes 60 of the mid-turbine frame 58 as the inlet guide vane for low pressure turbine 46 decreases the length of the low pressure turbine 46 without increasing the axial length of the mid-turbine frame 58. Reducing or eliminating the number of vanes in the low pressure turbine 46 shortens the axial length of the turbine section 28. Thus, the compactness of the gas turbine engine 20 is increased and a higher power density may be achieved.

The disclosed gas turbine engine 20 in one example is a high-bypass geared aircraft engine. In a further example, the gas turbine engine 20 includes a bypass ratio greater than about six (6:1), with an example embodiment being greater than about ten (10:1). The example geared architecture 48 is an epicyclical gear train, such as a planetary gear system, star gear system or other known gear system, with a gear reduction ratio of greater than about 2.3.

In one disclosed embodiment, the gas turbine engine 20 includes a bypass ratio greater than about ten (10:1) and the fan diameter is significantly larger than an outer diameter of the low pressure compressor 44. It should be understood, however, that the above parameters are only exemplary of one embodiment of a gas turbine engine including a geared architecture and that the present disclosure is applicable to other gas turbine engines.

A significant amount of thrust is provided by air in the bypass flowpath B due to the high bypass ratio. The fan section 22 of the engine 20 is designed for a particular flight condition—typically cruise at about 0.8 Mach and about 35,000 feet. The flight condition of 0.8 Mach and 35,000 ft., with the engine at its best fuel consumption—also known as "bucket cruise Thrust Specific Fuel Consumption ('TSFC')"—is the industry standard parameter of pound-mass (lbm) of fuel per hour being burned divided by pound-force (lbf) of thrust the engine produces at that minimum point.

"Low fan pressure ratio" is the pressure ratio across the fan blade alone, without a Fan Exit Guide Vane ("FEGV") system. The low fan pressure ratio as disclosed herein according to one non-limiting embodiment is less than about 1.50. In another non-limiting embodiment, the low fan pressure ratio is less than about 1.45.

"Low corrected fan tip speed" is the actual fan tip speed in ft/sec divided by an industry standard temperature correction of [(Tram ° R)/(518.7° R)]^0.5. The "Low corrected fan tip speed," as disclosed herein according to one non-limiting embodiment, is less than about 1150 ft/second.

The example gas turbine engine includes the fan 42 that comprises in one non-limiting embodiment less than about twenty-six (26) fan blades. In another non-limiting embodiment, the fan section 22 includes less than about twenty (20) fan blades. Moreover, in one disclosed embodiment the low pressure turbine 46 includes no more than about six (6) turbine rotors schematically indicated at 34. In another non-limiting example embodiment, the low pressure turbine 46 includes about three (3) turbine rotors. A ratio between the number of fan blades and the number of low pressure turbine rotors is between about 3.3 and about 8.6. The example low pressure turbine 46 provides the driving power to rotate the fan section 22 and therefore the relationship between the number of turbine rotors 34 in the low pressure turbine 46 and the number of blades in the fan section 22 disclose an example gas turbine engine 20 with increased power transfer efficiency.

Referring now to FIGS. 2-5, the high pressure compressor 52 of the compressor section 24 of the engine 20 includes arrays of blades 62 positioned axially between (vane or) stator clusters 64 and 66. The example engine 20 includes ten stator clusters 64 distributed circumferentially about the axis A to form an annular structure upstream from the blades 62. Other engines include other numbers of stators clusters 64.

In this example, the stator cluster 64 includes an inner air seal 70 supported by an inner air seal carrier 74. Individual stators 76 support the inner air seal carrier 74. Each of the stator clusters 64 includes from six to eleven stators 76. Other engines include other numbers of stators 76 within each stator cluster 64.

Knife-edge seals 78 extend from rotors of the high speed spool 32. The knife-edge seals 78 interface with the inner air seal 70 during operation of the engine 20 to provide a circumferentially extending seal. The inner air seal 70 is a honeycomb seal in this example. In other examples, the inner air seal 70 is a silicone rubber-based material, or rigid foam. The other examples would be particularly appropriate for relatively cooler components, such as the low pressure compressor 44 or the fan 42.

In this example, the stator cluster 64 is a first component 80 that is arranged within the engine 20 circumferentially adjacent to another stator cluster, which is a second component 80'. For clarity, the stators are not shown in FIG. 4, and the stators of the second component 80' are not shown in FIG. 5.

A gap g is positioned circumferentially between the first component 80 and the second component 80'. If not sealed, fluid may migrate through the gap g from a higher pressure downstream side $D_d$ to a lower pressure upstream side $D_u$.

Figure 4:
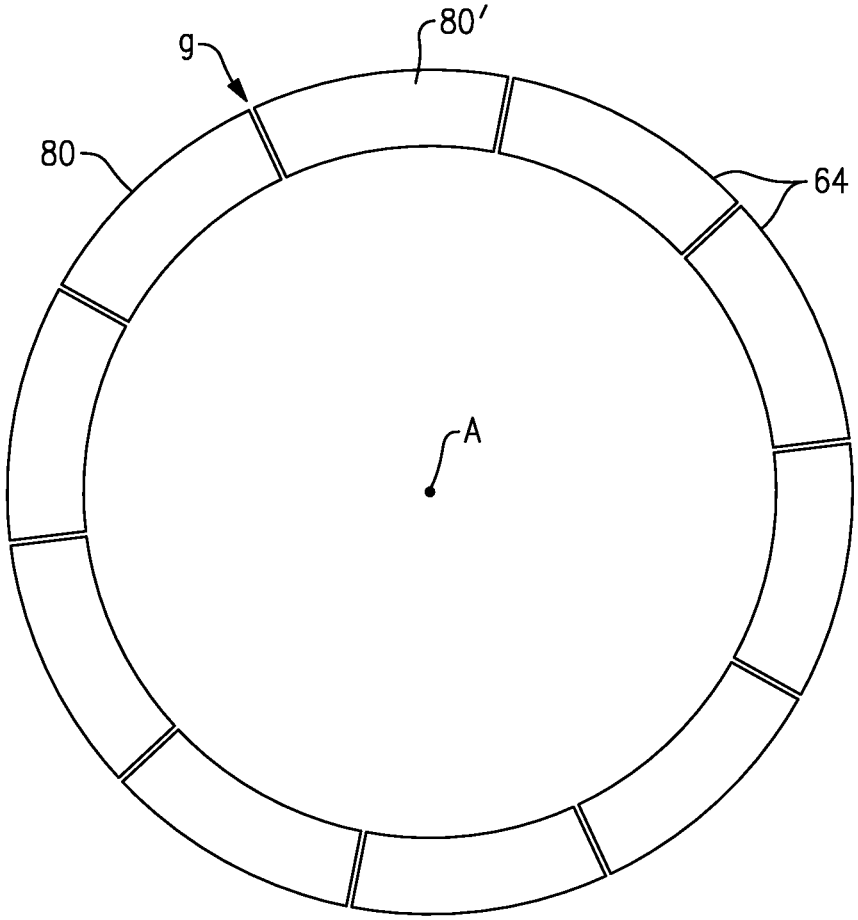
FIG. 4 shows a highly schematic view of an array of the stator clusters of FIG. 3.
Figure 5:
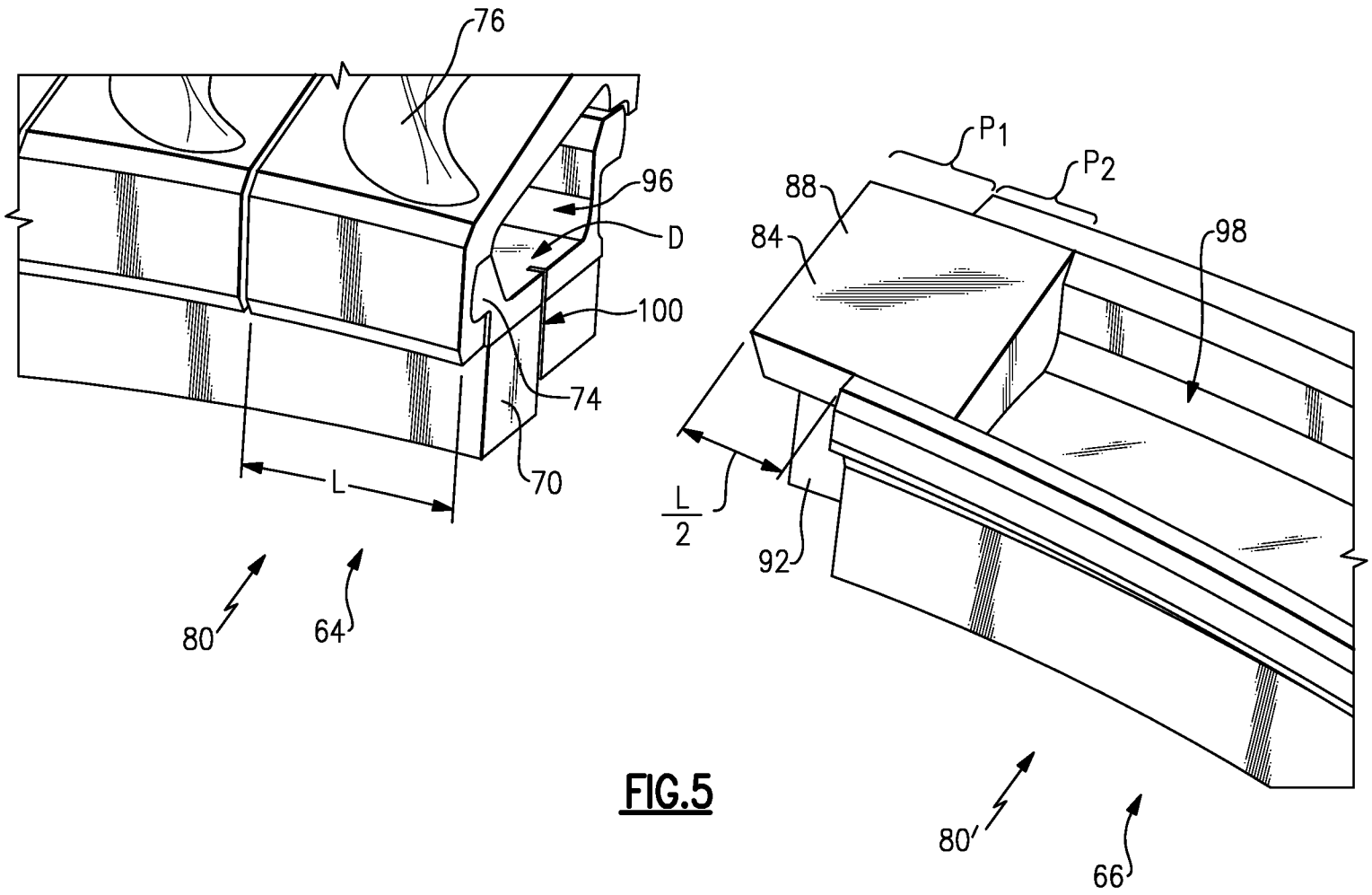
FIG. 5 shows an exploded view of a portion of the stator cluster of FIG. 3 and a portion of a circumferentially adjacent stator cluster.
Figure 6:
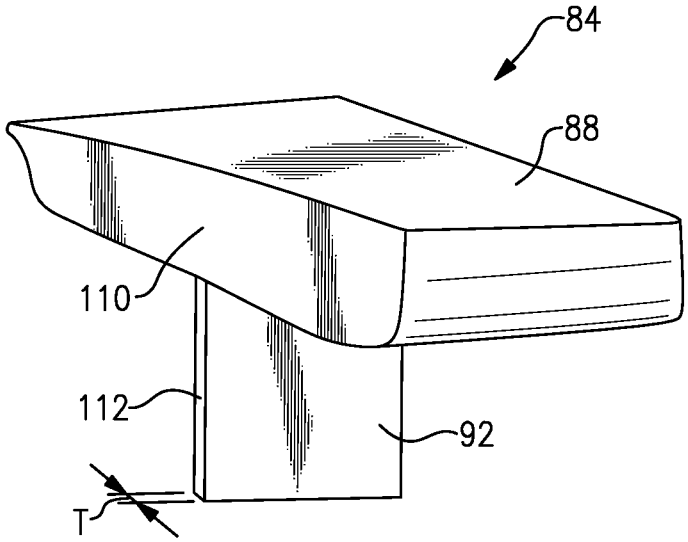
FIG. 6 shows a perspective view of a sealing plug used within the compressor section of FIG. 2.
Figure 7:
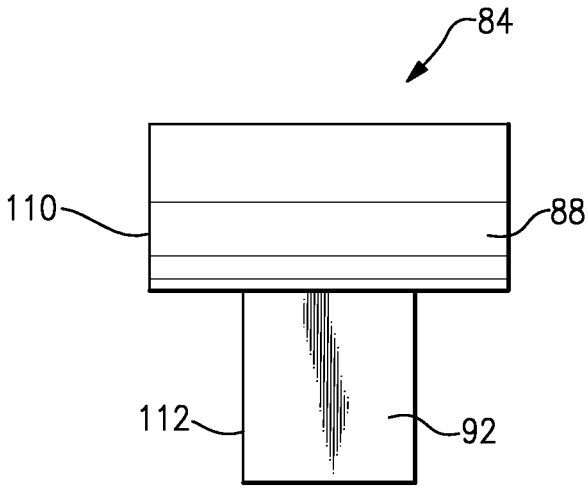
FIG. 7 shows a front view of the sealing plug of FIG. 6.

Referring now to FIGS. 6 and 7 with continuing reference to FIGS. 4 and 5, a seal 84 limits flow through the gap g. The example seal 84 includes a plug body 88 and a fin 92 extending radially inward from the plug body 88 toward the axis A. In some examples, the fin 92 is not utilized.

In this example sealing assembly, the seal 84 limits flow at the interface between circumferentially adjacent stator clusters within the high pressure compressor 52. The interface includes a gap g, and the seal 84, specifically, limits flow through the gap g. In other examples, the seal 84 may limit flow at interfaces between other types of components, such as arrays of circumferentially adjacent components in the turbine section 28.

Within the engine 20, there are gaps between other circumferentially adjacent stator clusters in addition to the gap g between the stator clusters 64 and 66. The gaps are distributed about the axis A.

In some examples, one of the seals 84 blocks each of the gaps. After the stator clusters 64, 66 and the other stator clusters are assembled to form the annular structure, installing a seal to block the remaining gap may be complicated. Thus, in other examples, due to assembly complications, one of the gaps is left open and is not blocked by one of the seals 84.

When assembled, the plug body 88 includes a first portion $P_1$ that is received within a cavity 96 of the stator cluster 64, which is the first component 80 in this example. A second portion $P_2$ of the plug body 88 is received within a cavity 98 of the stator cluster 66, which is formed within the second component 80'. In this example, about half of the plug body 88 is positioned within the cavity 96, and the remaining half of the plug body 88 is positioned within the cavity 98 of the second component 80'.

The stators 76 have a circumferential length L. The circumferential length of the plug body 88 received within the cavity 96, the first portion $P_1$, is about half of the circumferential length L. Receiving about half of the plug body 88 within the cavity 96 facilitates accommodating other structures within the cavity 96, such as damping members associated with each of the stators 76. The circumferential length of the plug body 88 received within the cavity 96 is about 0.25 inches (6.35 millimeters) in this example.

When assembled, the fin 92 is at least partially received within a radial groove 100. The example groove 100 extends across portions of both the air seal carrier 74 and the inner air seal 70.

In this example, the groove 100 has a circumferential depth D that is less than or equal to 0.030 inches (0.762 millimeters). The example fin 92 extends axially a distance T that is less than or equal to 0.025 inches (0.6350 millimeters). A distance S from a circumferential face 110 of the plug body 88 to a circumferential face 112 of the fin 92 is about 0.22 inches (5.588 millimeters).

The example fin 92 may be brazed to the plug body 88. The fin 92 could also be cast together with the plug body 88 or machined together with the plug body 88 as a single structure. That is, the seal 84 is formed of a single unitized monolithic structure in some examples.

The example seal 84 is considered a bayonet seal in some examples. The features of the example seal include sealing a gap between circumferentially adjacent components to reduce surge deflections in the engine 20. The seal 84 is also accessible for repair when the stator clusters are removed.

Although an embodiment of this invention has been disclosed, a worker of ordinary skill in this art would recognize that certain modifications would come within the scope of this invention. For that reason, the following claims should be studied to determine the true scope and content of this invention.

I claim:

1. A seal, comprising:

a plug body to limit flow through an axially extending interface between a first component and a second component, the plug body to limit flow when positioned within both a cavity of the first component and a cavity of the second component, the cavity of the first component established between a first stator platform and a first inner air seal carrier, the cavity of the second component established between a second stator platform and a second inner air seal carrier; and a fin extending radially directly from a radially facing surface of the plug body, the fin disposed outside the cavity of the first component and outside the cavity of the second component, wherein the first component comprises a stator having a vane extending radially from a base, wherein a portion of the plug is circumferentially aligned with the vane of the stator.

2. The seal of claim 1, wherein the fin extends axially a distance that is less than or equal to 0.025 inches.

3. The seal of claim 1, wherein the fin is configured to fit within a groove of the first component.

4. The seal of claim 3, wherein the groove is a radially extending groove that has a circumferential depth that is less than or equal to 0.030 inches.

5. The seal of claim 1, wherein half of the plug body is positioned within the cavity of the first component, and half of the plug body is positioned within the cavity of the second component.

6. The seal of claim 1, wherein the seal includes no more than one fin.

7. The seal of claim 1, wherein the first inner air seal carrier includes a hook that engages a lip of the first stator platform to secure the first inner air seal carrier relative to the first stator platform.

8. The seal of claim 1, wherein the stator has a circumferential length, wherein the amount of the plug received within the cavity of the first component is half of the circumferential length.

9. A sealing assembly, comprising:

a first stator platform that defines a first cavity together with a first carrier, a first inner air seal supported by the first carrier;

a second stator platform that defines a second cavity together with a second carrier, a second inner air seal supported by the second carrier;

a vane extending radially from the stator platform, wherein a portion of the plug is circumferentially aligned with the vane of the stator;

a seal that is received within both the first cavity and the second cavity, the seal to limit flow through gap between the first stator platform and the second stator platform, the gap is open and extends uninterruptedly in a radial direction from the cavity to a radially outer surface of the first stator platform and a radially outer surface of the second stator platform; and a flange extending radially from the seal, the flange received with a groove of the first inner air seal, the flange disposed outside the first and second cavities, wherein the first carrier includes a hook that engages a lip of the first stator platform to secure the first carrier relative to the first stator platform.

10. The sealing assembly of claim 9, wherein the first and second inner air seals are honeycomb seals.

11. The sealing assembly of claim 9, wherein the sealing assembly forms a portion of a gas turbine engine having a geared architecture.

12. The sealing assembly of claim 9, wherein the seal include no more than one flange.

13. A method of sealing an interface, comprising:

positioning a first portion of a seal within a cavity of a first component;

positioning a second portion of the seal within a cavity of a second component;

limiting flow through an axially extending interface between the first component and the second component using the seal; and providing the cavity of the first component with a first carrier that hangs from a platform of a first stator, the first carrier supporting a first inner air seal, and providing the cavity of the second component with a second carrier that hangs from a platform of a second stator, the second carrier supporting a second inner air seal, wherein the first stator includes a vane extending radially from the platform, wherein a portion of the plug is circumferentially aligned with the vane of the first stator.

14. The method of claim 13, comprising fitting a fin extending radially from a plug body of the seal within a radially extending groove provided by the first component, wherein the fin is disposed outside the cavity of the first component and disposed outside the cavity of the second component.

15. The method of claim 13, wherein the first and second components are within an array of stator clusters.

16. The method of claim 13, including sealing against a knife-edge seal using the first component.

17. The method of claim 13, further comprising hooking the first carrier to the first stator platform to hang the first carrier from the first stator platform.

* * * * *